United States Patent [19]

Bingham et al.

[11] 4,008,577

[45] Feb. 22, 1977

[54] CUT AND COVER CONSTRUCTION OF SUBWAY WITH UTILITY CHAMBER AND AIR CONDITIONING WITH MINIMUM STREET TRAFFIC DISTURBANCE

[76] Inventors: Sidney H. Bingham, 109 E. 35th St., New York, N.Y. 10016; William H. Eberhardt, 3 Wheatley Ave., East Williston, N.Y. 11596

[22] Filed: Mar. 5, 1975

[21] Appl. No.: 553,793

Related U.S. Application Data

[62] Division of Ser. No. 519,254, Oct. 31, 1974, Pat. No. 3,914,916.

[52] U.S. Cl. ..... 61/44; 61/39; 52/169.6; 404/71

[51] Int. Cl.[2] ..... E01G 4/02; E02D 5/00

[58] Field of Search ..... 61/44, 43, 42, 45, 39; 404/71; 52/169

[56] References Cited

UNITED STATES PATENTS

| | | | |
|---|---|---|---|
| 358,331 | 2/1887 | Blanc | 61/44 |
| 922,768 | 5/1909 | Jackson | 61/44 |
| 977,306 | 11/1910 | Hess | 61/44 |
| 1,032,952 | 7/1912 | Shnable | 61/44 |
| 2,059,774 | 11/1936 | Caccia | 61/44 |
| 3,555,979 | 1/1971 | Veder | 61/44 X |

*Primary Examiner*—Jacob Shapiro

[57] ABSTRACT

The invention relates to forming spaced apart pits along the outer edges of the subway site which can be immediately covered with steel plates to permit normal traffic flow. The plates are removed and soldier beams placed at spaced positions in each pit. As excavation proceeds timber lagging is inserted between the soldier beams. When the excavation is made between the soldier beams, timber bracing and caps are installed across the tops of the soldier beams to receive the precast decking. Further soldier beams are then driven between the aforementioned soldier beams after the decking and bracing are removed. Excavation then can be made to permit construction of concrete walls along said further soldier beams longitudinally to comprise the outermost edges thereof. Sewer and gas mains are then laid along the concrete walls of either or both of them, optionally, but preferably exterior thereof to permit ready connection to dwellings or buildings. Trenches are formed laterally of the subway site at spaced apart locations to receive decking beams which are covered by concrete decking as excavation proceeds. The concrete decking is removed when sufficient trenches have been made to erect the steel decking beams. The concrete decking is then placed on the decking beam supports. Portions of the concrete decking are to be made removable, when street traffic permits, to permit completion of excavation and provide access for construction materials.

3 Claims, 16 Drawing Figures

FIG. 1 *PRIOR ART*

FIG. 13
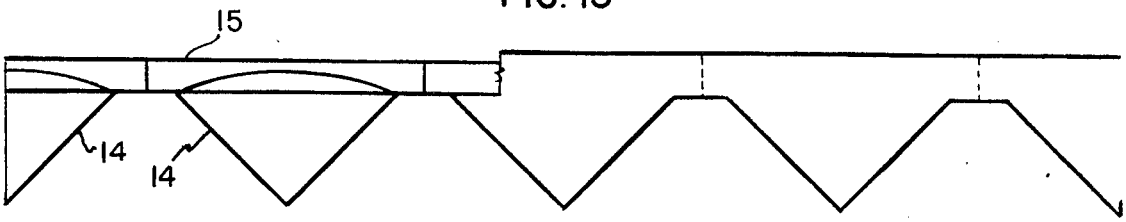
FIG. 14
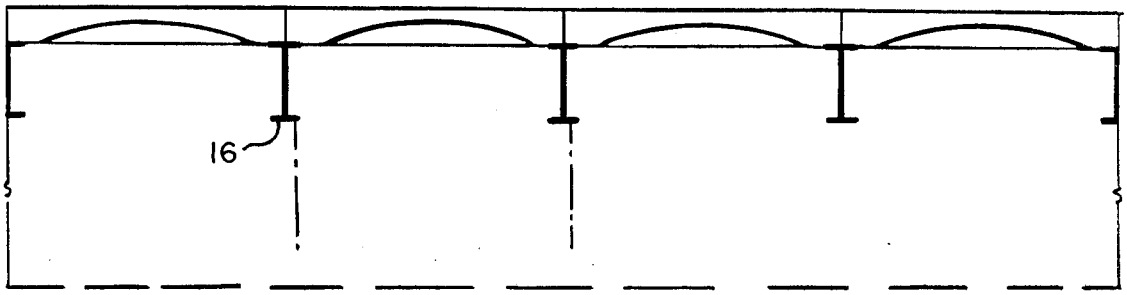
FIG. 15
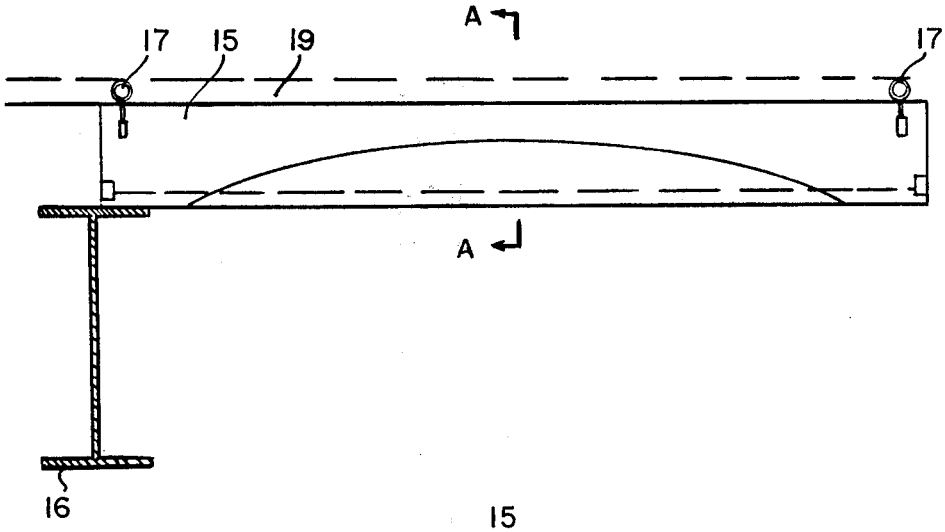
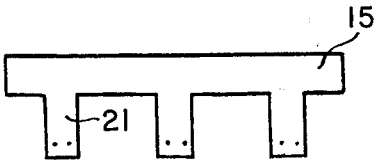
FIG. 16

CUT AND COVER CONSTRUCTION OF SUBWAY WITH UTILITY CHAMBER AND AIR CONDITIONING WITH MINIMUM STREET TRAFFIC DISTURBANCE

This is a division of application Ser. No. 519,254 filed Oct. 31, 1974, and now U.S. Pat. No. 3,914,916.

The present invention relates to a new method of constructing a novel subway, and may be referred to descriptively as a cut and cover method because it causes a minimum of traffic disturbance.

Spaced apart pits are dug along the outer edges of the subway site to permit driving of short soldier beams. As excavation proceeds these pits may be covered with steel plates to accommodate normal street traffic. After a number of pits have been excavated, the steel plates may be removed and short soldier beams are driven. Excavation is then to be made to approximately 6 feet 0 inches below street grade. Timber lagging is placed between flanges of the soldier beams as excavation proceeds. Timber caps are placed on the soldier beams which also are to have timber bracing and the excavated area covered by concrete decking, which permits normal traffic flow.

Solider beams for the subway excavation are then driven and excavation made to 11 feet 6 inches below the street grade. Concrete walls enclosing the upper portion of the soldier beams are then poured.

Gas and sewer lines are laid exterior to the concrete wall and backfill placed to approximately one foot below the top of the soldier beams. The now unused soldier beams are removed to permit trenching laterally of the subway at spaced locations to accommodate decking beams which are to rest on the soldier beams for the subway excavation. The decking beams in turn support concrete decking to permit normal traffic flow.

When further excavation is undertaken, the decking is removed as required and excavation proceeds to 10 feet 0 inches feet which completes the digging of a utility chamber to be housed above the train tunnel. Utilities are suspended by hangers from the decking beams until the subway is completely formed, i.e., to its 28 feet 0 inches depth or so, between the later driven soldier beams extending below the concrete walls. A steel supported concrete floor separates the utility chamber from the tunnel and the chamber may serve as an air conditioning duct, if desired. Sections of the precast concrete decking are removed when traffic conditions permit to remove excavated materials and supply items needed for construction.

The concrete decking may include lift rings to facilitate removal.

Finally, the asphalt or other final surface is placed over the concrete decking. Cut and cover construction permits a free flow of street roadway traffic during peak usage. The utility chamber mades unnecessary the continual opening of streets for installation and servicing of underground utilities. A single manhole in the middle of each block is sufficient for all underground installations instead of the usual twelve or more manholes per block. The elimination of the extra street openings for installation and servicing reduces the number of potholes and results in safer and easier travelling. Annular rental of the utility chambers provides non-operating revenue to the rapid transit system which can be used to reduce operating costs and fares.

The subject invention will be better understood from a reading of the following detailed description when taken in conjunction with the appended drawings wherein:

FIG. 13 shows typical trenching with concrete decking to initiate excavation of the subway itself;

FIG. 14 shows the concrete decking supported by the decking beams as seen along the plane G—G of FIG. 11;

FIG. 15 is a detailed view of a portion of FIG. 16; and

FIG. 16 is a further detailed view of a portion of FIG. 15 taken along the plane A—A.

Figure 1:
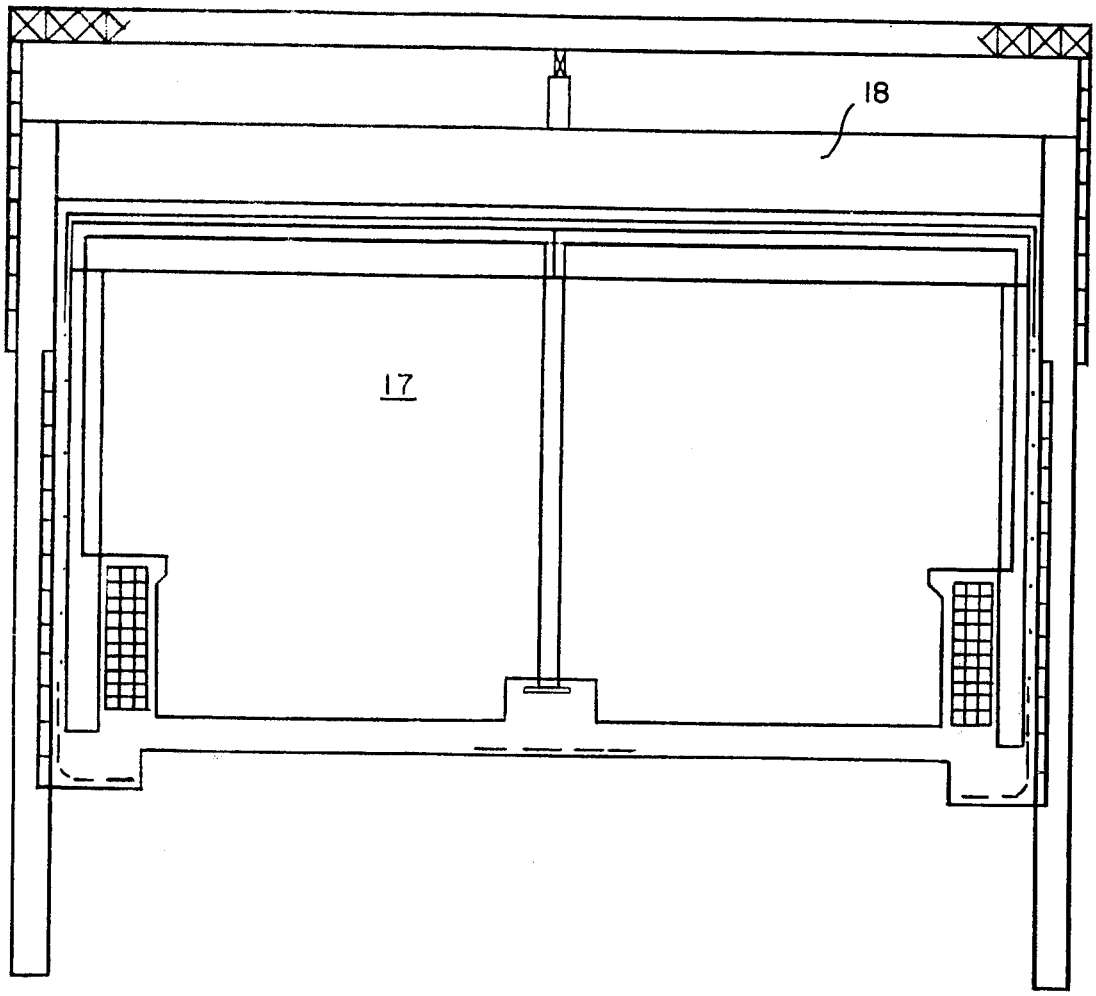
FIG. 1 is a cross-sectional view of a typical subway between stations.

In FIG. 1 a typical subway tunnel is shown wherein the train tunnel is generally marked at 17 and the backfill indicated at 18, primarily to reveal the loss of space, this tunnel being dug to a depth of 24.7 feet.

Figure 2:
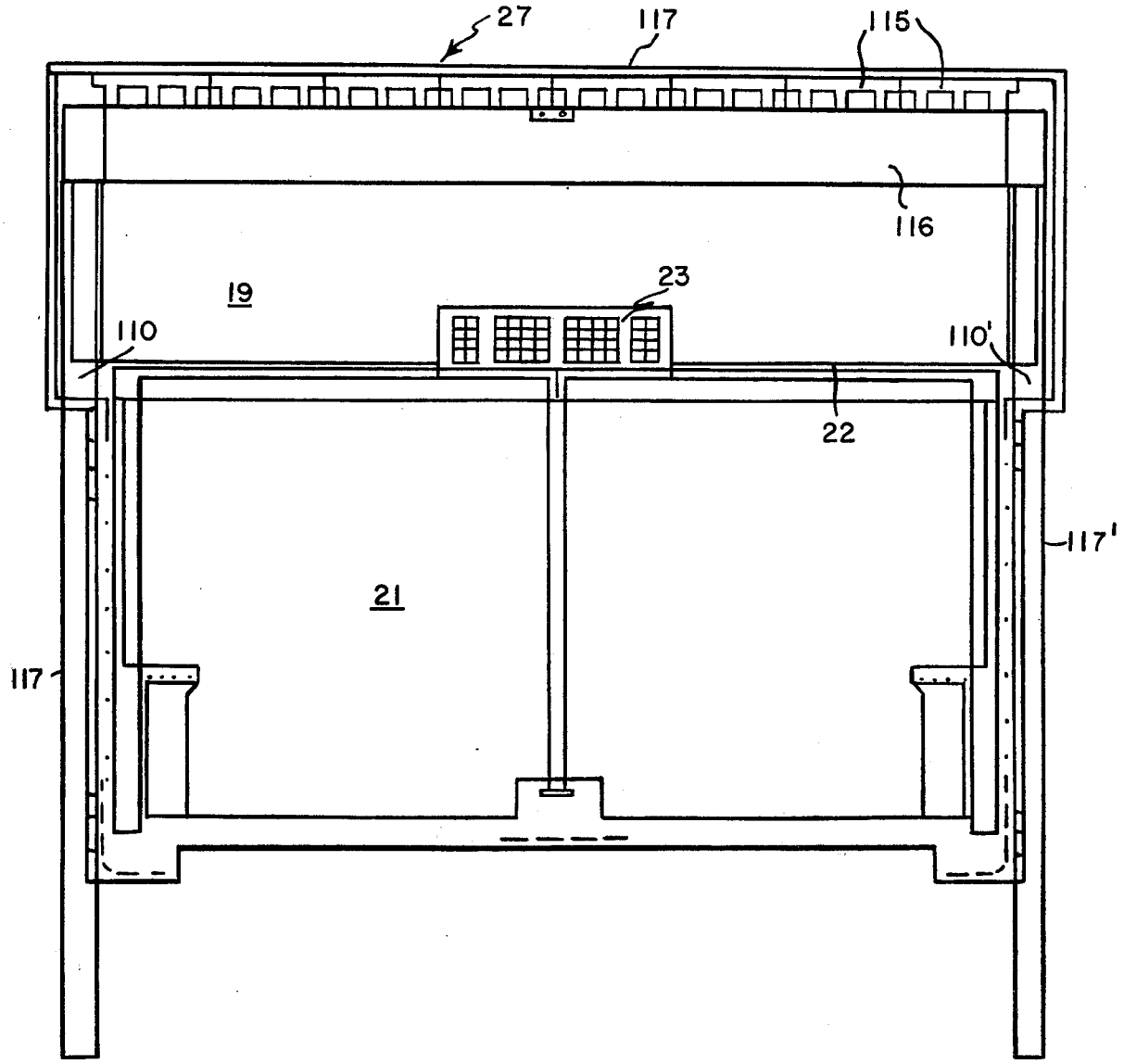
FIG. 2 is a cross-section of a subway in accordance with the present invention.
Figure 7:
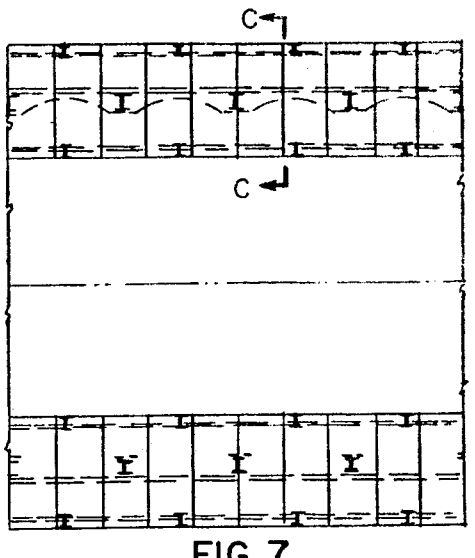
FIG. 7 shows the subway site in plan to illustrate further steps of the method.
Figure 8:
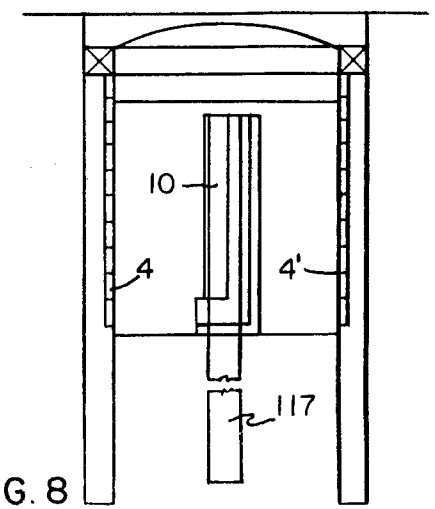
FIG. 8 is a cross-sectional view taken along the plane G—G of FIG. 7.

In contrast, in FIG. 2, although the tunnel is only 28 feet 0 inches deep, for example it includes a large utility space 19 above the train tunnel 21. Also, grating 22 may be seen in the floor separating these two chambers. Subway ducts 23 are included in the utility chamber 19. The utility chamber is the region which provides the non-operating income and may also serve as a large air conditioning duct. The main lateral supports for the street itself, generally shown at 27, are the decking beams 116 in turn supporting the concrete decking 115 which carry the asphalt or other coating 117. The so-called further soldier beams 117 and 117' are seen as the sides of the excavation for tunnel 21 with the poured concrete walls 110 and 110' defining the outer walls of the utility chamber 19. Also, as can be seen, these concrete walls and soldier beams 110 and 110' support decking beam 116.

To proceed with the construction, it may be seen that the plan views of FIGS. 3, 5, 7, 9 and 11 are above the cross-sectional views extracted therefrom as seen in FIGS. 4, 6, 8, 10 and 12. Thus, in FIG. 3, the outline of subway excavation 131 is wider than the completed subway.

A plurality of pits or, alternatively, two pairs of trenches, such as trench 1 and 1' are first dug to a level of something over 2 feet longitudinally of the site 131. Trench 1 is exterior of the location of the final wall of the subway and trench 1' is interior thereof. In any event, these trenches can be covered with steel plates to permit normal traffic to resume and facilitate ready removal for driving soldier beams and further excavation at the proper time. The trenches, by way of soldier beams 2 and 2' to be driven to, for example, a depth of 18 feet and form the side walls for further excavation using the timber lagging 4 and 4' being placed as the excavation proceeds.

Figure 5:
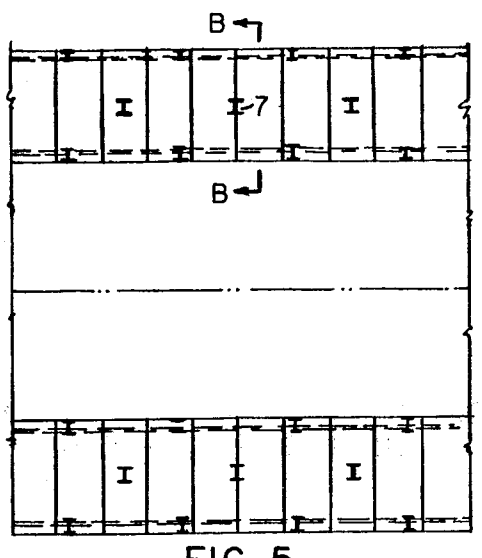
FIG. 5 shows the next step in the method as illustrated by viewing the subway site in plan.
Figure 6:
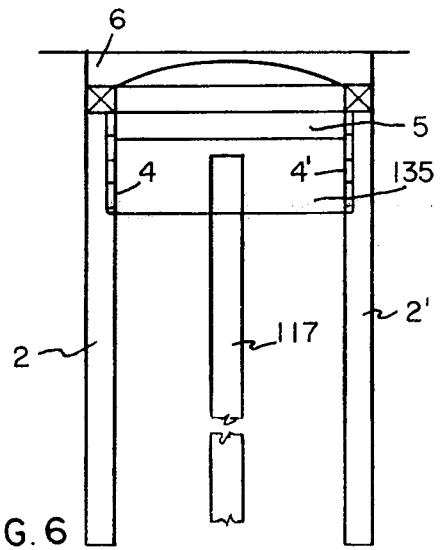
FIG. 6 is a cross-sectional view taken along the plane B—B of FIG. 5.
Figure 3:
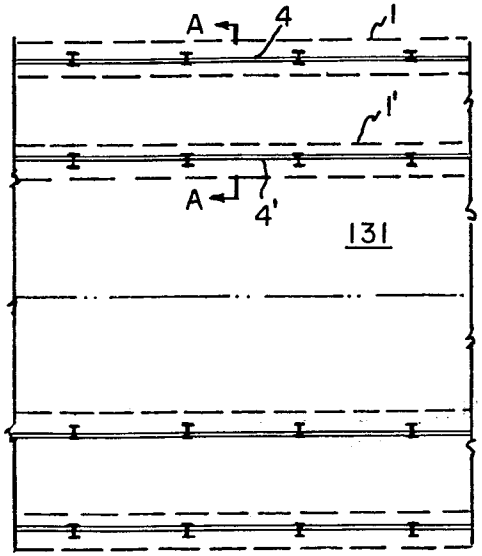
FIG. 3 is a view in plan of the subway site showing early steps of the method.
Figure 4:
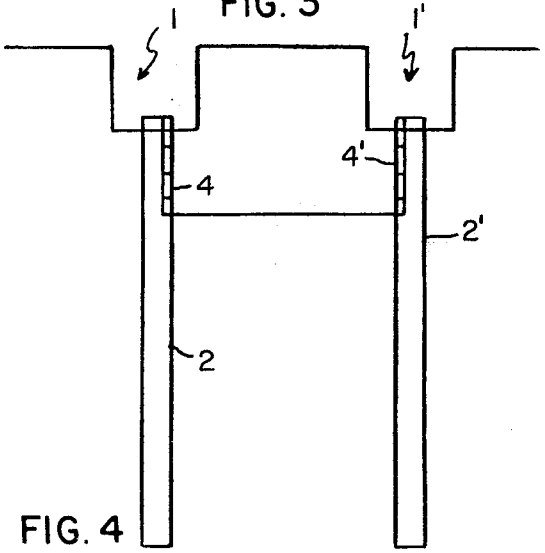
FIG. 4 is a section taken along the plane A—A.
Figure 9:
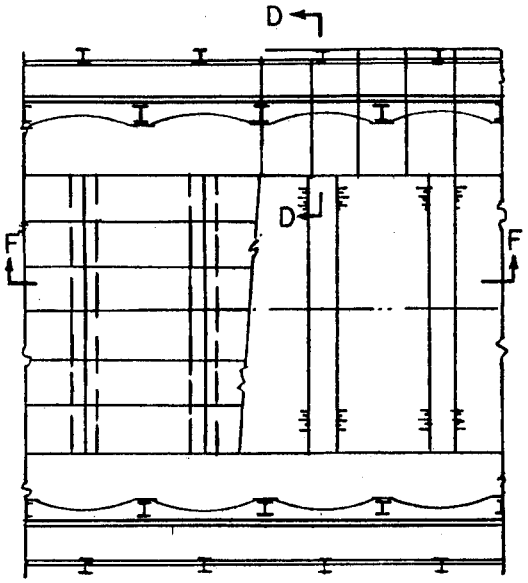
FIG. 9 is a further plan view of the subway site to show additional construction.
Figure 11:
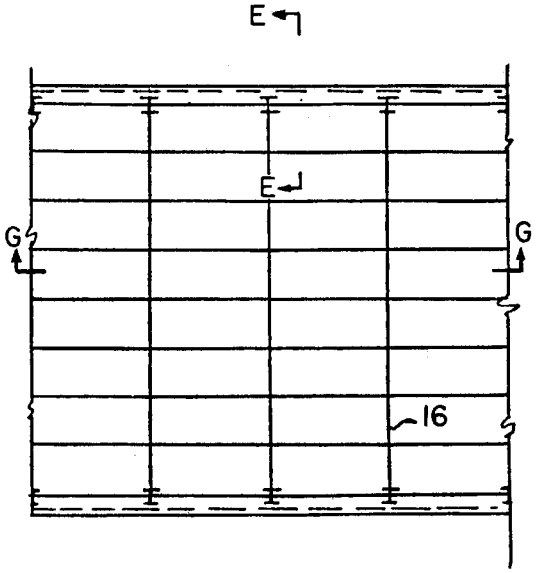
FIG. 11 is a view of the subway, in plan, nearly completed.

Next, FIGS. 5 and 6 illustrate the beginning step in forming the side 110 of train tunnel 21. Excavation has intermittently continued forming a trench 135 which is covered by timber bracing and caps 5, supported on top of the original soldier beams 2 and 2' or the timber lagging 4 and 4' extending therebetween and the timber caps 5 in turn support precast decking 6. This decking may be removed to drive the further soldier beams 117 down to the 24 feet 0 inches level.

Next, a concrete wall 10 is poured using the soldier beams 117 as a member therefor to comprise the outer walls 110 and 110' of utility chamber 19. Also, in FIG. 8, it may be seen that excavation had first proceeded to the −11.6 feet level and further timber lagging 4 and 4' added to contain the earth.

Figure 10:
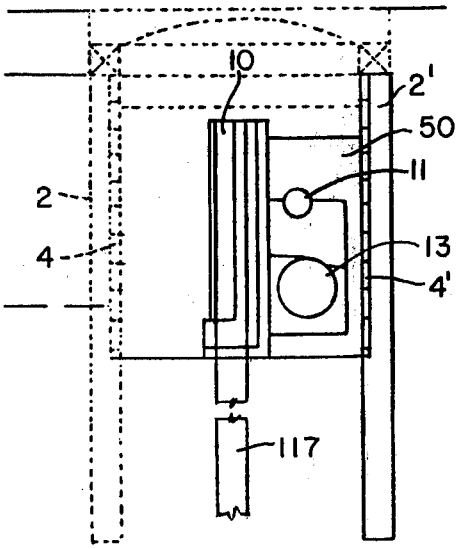
FIG. 10 is a sectional view taken along the line D—D.
Figure 12:
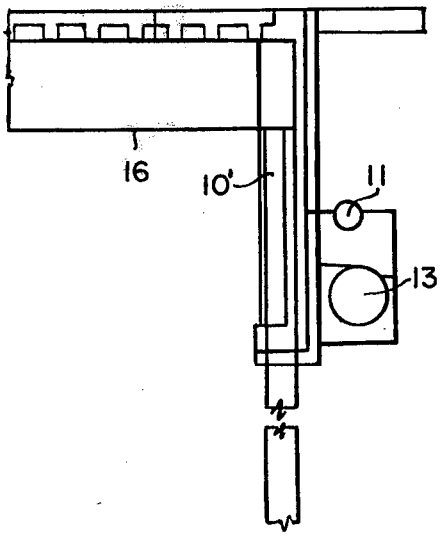
FIG. 12 is a view in section taken along the plane E—E of FIG. 11.

FIG. 10 shows the addition of gas mains 11 and sewer main 13 and backfill 50 to one side or both sides of the wall 10 to permit the removal of the concrete decking, and the timber bracing and caps. If the sewer and gas mains are placed exteriorly of wall 10 it is much easier to connect them to dwellings or buildings because it is then not necessary to break through the wall 10 or surface right-of-way.

Soldier beams 2 and 2' are also removed along with lagging 4 and 4' to leave only the further soldier beams 117 and concrete wall 110 with sewer and gas mains.

Next the trenches 14 are dug laterally of the street between the concrete walls 10 and 10' or (110 or 110' of FIG. 2 when associated with the utility chamber 19) to permit laying of the decking beams 16 as supported by the soldier beams 10 and 10'. The trenches 14 can be covered with concrete decking 15 to permit normal travel and then selectively removed for installing decking beams 16 and for further excavation. For this purpose, lifting rings 17 are provided.

The next step is to excavate down to the 10 feet 0 inches ± level to form the utility chamber.

The utilities are temporarily supported from the decking steel beams in the utility chamber 19 and so do not interfere with further excavation of the subway tunnel 21.

Sections of the precast concrete decking 15 may be removed when traffic conditions permit to remove excavated materials and supply items needed for construction.

The asphalt roadway 19 is finished over the concrete decking 15 when the decking has been finally installed permanently.

In FIG. 16 the decking 15 is shown with the reinforcing ribs 21 which may comprise 2 to 7 wire steel strands embedded in 5,000 pound concrete.

It may now be appreciated why the 6 foot minimum clearance utility chamber is significant to permit workmen to service 30 or 40 different types of utility facilities. Also, no air need be pumped to a man in a manhole.

Such annually recurring non-operating income greatly reduces the financial burdens to cities now wishing to install subway systems and permits the cities either to pay back part of the funds granted by Urban Mass Transportation Administration of the Department of Transportation or aid them in meeting operating deficits. The life of subways is 100 years.

Also, many regulations apply to manhole use and this is truly costly to cities and a nuisance to traffic.

Utilities are permanently buried, and servicing requires excavation, which the present invention completely eliminates.

The construction presented herein enables workmen to operate in all types of weather and with improved efficiency.

Basically, the materials used in the subway construction remain, and this eliminates costly temporary streets and so forth.

What is claimed is:

1. An underground subway having longitudinal edges and an exposed finished roadway, comprising:
   - a plurality of spaced apart soldier beams embedded underground along each of said edges, the soldier beams of the respective pluralities being oppositely located;
   - concrete walls partially embedding each plurality of soldier beams to define said edges;
   - said walls bounding a utility chamber;
   - a train tunnel beneath said utility chamber;
   - air penetrable flooring for the utility chamber separating the chamber from the train tunnel to support utilities and accommodate air conditioning;
   - transverse decking beams supported by the oppositely disposed soldier beams; and,
   - precast concrete ribbed arch concrete ribbed arch decking carried by said decking beams to support said finished roadway.

2. The subway of claim 1 wherein said walls define backfill regions exteriorly thereof for locating gas and sewer facilities.

3. The subway of claim 1 wherein said soldier beams extend beneath the utility chamber to outline the train tunnel.

* * * * *

UNITED STATES PATENT AND TRADEMARK OFFICE

CERTIFICATE OF CORRECTION

PATENT NO. : 4,008,577

DATED : February 22, 1977

INVENTOR(S) : Sidney H. Bingham; William H. Eberhardt

It is certified that error appears in the above-identified patent and that said Letters Patent are hereby corrected as shown below:

On cover sheet, item [62] change Patent No. 3,914,916 to Patent No. 3,914,946.

In column 1, line 8 change incorrect Patent No. 3,914,916 to correct Patent No. 3,914,946.

Signed and Sealed this

*fifth* Day of *July 1977*

[SEAL]

*Attest:*

RUTH C. MASON
*Attesting Officer*

C. MARSHALL DANN
*Commissioner of Patents and Trademarks*